US005223810A

United States Patent [19]

Van Haaren

[11] Patent Number: 5,223,810

[45] Date of Patent: Jun. 29, 1993

[54] TRIP-RESET MECHANISM FOR GFCI RECEPTACLE

[75] Inventor: Christopher A. Van Haaren, Tiverton, R.I.

[73] Assignee: General Electric Company, Schenectady, N.Y.

[21] Appl. No.: 932,524

[22] Filed: Aug. 20, 1992

[51] Int. Cl.[5] ..... H01H 73/00

[52] U.S. Cl. ..... 335/18

[58] Field of Search ..... 335/18, 202; 361/42, 361/43, 44, 45, 46, 47, 48, 49

[56] References Cited

U.S. PATENT DOCUMENTS 4,013,929 3/1977 Dietz et al. .
4,034,266 7/1977 Virani et al. .
4,086,549 4/1978 Slater et al. .
4,409,574 10/1983 Misencik et al. .
4,574,260 3/1986 Franks .
4,595,894 6/1986 Doyle et al. .
4,630,015 12/1986 Gernhardt et al. .
4,719,437 1/1988 Yun .
4,802,052 1/1989 Brant et al. .

*Primary Examiner*—Lincoln Donovan
*Attorney, Agent, or Firm*—Edward M. Corcoran; Stanley C. Corwin

[57] ABSTRACT

To minimize the tripping force required to trip a GFCI receptacle, a cantilever spring, formed as an integral feature of the molded plastic receptacle case, is charged in the process of resetting a trip/reset mechanism from a tripped condition and thus is empowered to provide a spring force for setting a latch releaseably holding the mechanism in a reset condition and for returning a trip solenoid plunger from its trip-initiating extended position to a return position. While the mechanism is reset, the cantilever spring is clear of the tripping motions of the latch and plunger.

10 Claims, 3 Drawing Sheets

TRIP-RESET MECHANISM FOR GFCI RECEPTACLE

The present invention relates to circuit interrupters and particularly to ground fault-protected receptacles.

BACKGROUND OF THE INVENTION

Ground fault circuit interrupters (GFCI) are widely used in residential circuits as protective devices to prevent potentially lethal electric shock to appliance users in the event of a ground fault. GFCI devices, in response to a differential in the current flowing in the line and neutral conductors of a load circuit indicative of a ground fault, energize a solenoid which then acts via a trip mechanism to open contacts and thus interrupt the circuit. Circuit interruption is achieved with requisite speed such that the flow of ground fault current through a person's body is halted before any injury is inflicted.

One configuration of a GFCI is that of a receptacle installed in a wall outlet box. As compared to a non-ground fault receptacle, a typical GFCI receptacle includes many additional components, such as pairs of fixed and movable contacts, a trip/reset mechanism, a solenoid, a differential current transformer, a ground neutral transformer, an electronic circuit board, internal wiring, etc. Since a GFCI receptacle must fit in a standard size outlet box, these components must be miniaturized and densely packaged to achieve a compact design conducive to facile installation even for the do-it-yourself homeowner.

One of the more spacious components in a GFCI receptacle is the solenoid which acts to defeat a latch in the trip/reset mechanism and allow the circuit interrupting contacts to spring open. Typically, the solenoid plunger is biased by a spring to a quiescent or return position in spaced relation to the trip latch. When a circuit interruption is called for, the solenoid coil is energized to magnetically drive the plunger to an extended position, in the process striking the latch to release the trip/reset mechanism and open the contacts. Since the magnetic force on the plunger must overcome the plunger return spring bias, the magnetic circuit of the solenoid must be fairly robust, thus adding size and cost.

The trip/reset mechanism is another component that make significant contributions to the size and cost of a GFCI receptacle. This mechanism must handle the trip and reset functions, and also must be designed to defeat any attempt to manually close or hold closed the contacts in presence of a ground fault, such as by continued depression of the mechanism reset button. To accommodate these various functions, the typical trip/reset mechanism design calls for a multiplicity of intricate parts representing significant manufacturing costs.

SUMMARY OF THE INVENTION

It is accordingly an objective of the present invention to provide an improved GFCI receptacle which is efficient in design, compact in size and economical to manufacture. A more specific objective is to provide an improved trip/reset mechanism for a GFCI receptacle, which performs its various functions using a minimal number of parts. In addition, the trip/reset mechanism accommodates a cost improved and less spacious trip solenoid which need develop only minimal tripping force to defeat the mechanism latch and thus precipitate circuit interruption.

To these ends, the GFCI receptacle of the present invention includes movable contacts mounted by resilient straps sprung to normally dispose the movable contacts in respective open circuit positions relative to fixed contacts. A commutator is mounted by the molded plastic receptacle case for reciprocating movement between tripped and reset positions and includes a cross beam underlying the resilient strips to draw the movable contacts into closed circuit positions engaging the fixed contacts when the commutator assumes its reset position.

A reset button is also mounted by the receptacle case for reciprocating movement between manually depressed position and a released position to which it biased by at least one reset spring. An elongated latch is pivotally mounted to the reset button in depending relation and includes a catch for latchingly engaging a shoulder of the commutator in its tripped position during manual depression of the reset button to its depressed position. Only when the reset button is released is the commutator drawn to its reset position and thus the movable contacts to their closed circuit positions by the reset spring which thus also serves as a contact closing spring.

When a circuit interruption is called for, the coil of a trip solenoid is energized to magnetically drive its plunger from a return position to an extended position, in the process striking the latch to disengage its catch from the commutator shoulder. The movable contacts are then freed to spring to their open circuit positions and thus push the commutator to its tripped position. A latch spring is positioned to engage the latch only during depression of the reset button and apply a latch setting force thereto, which is effective to ensure that the latch catch reacquires latching engagement with the commutator shoulder during the manual reset operation. To eliminate the need for a solenoid return spring, the latch spring, in addition to resetting the latch, also drives the solenoid plunger to its return position. When the reset button is released, the latch is drawn out of engagement with the latch spring, and thus it applies no spring force to the trip/reset mechanism that must be overcome by the trip solenoid.

The invention accordingly comprises the features of construction, combination of elements, and arrangement of parts, all as detailed hereinafter, and the scope of the invention will be indicated in the claims.

BRIEF DESCRIPTION OF THE DRAWINGS

For a full understanding of the nature and objectives of the present invention, reference may be had to the following Detailed Description taken in conjunction with the accompanying drawings, in which.

Corresponding reference numerals refer to like parts throughout the several views of the drawings.

DETAILED DESCRIPTION

Figure 1A:
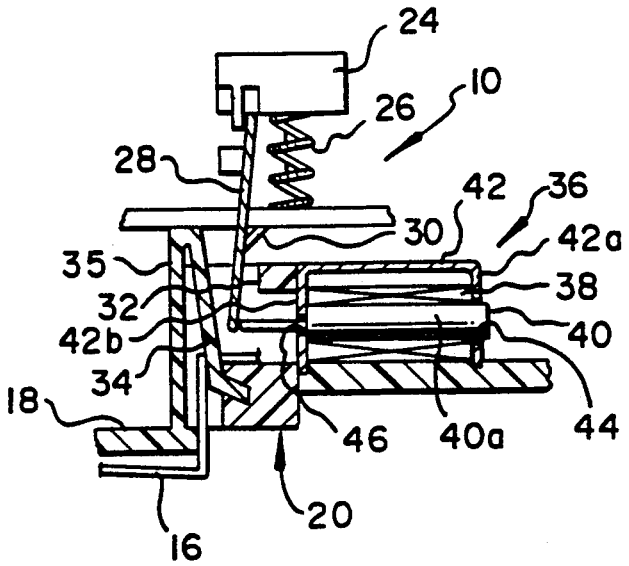
FIGS. 1(*a*)–1(*e*) are a series of fragmentary views of a GFCI receptacle constructed in accordance with the present invention to illustrate successive positions of its various parts during a manual resetting operation converting the receptacle from its tripped condition of FIG. 1(*a*) to its reset condition of FIG. 1(*e*)
Figure 1B:
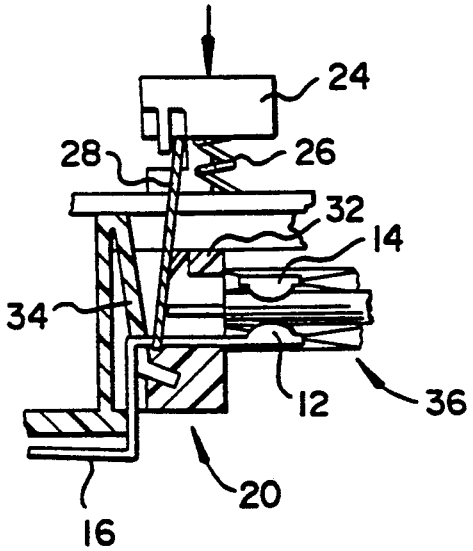
Figure 1C:
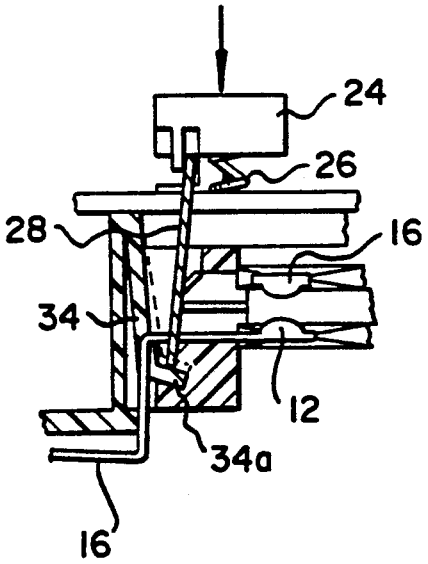
Figure 1D:
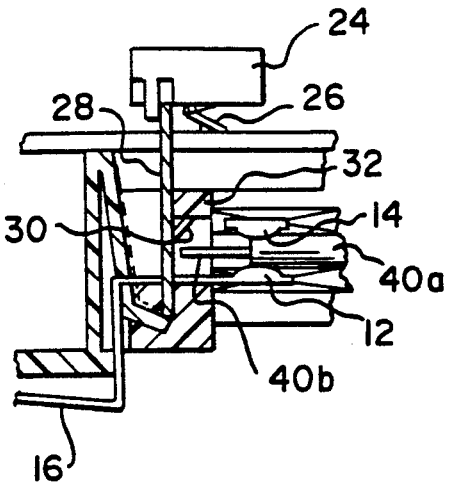
Figure 1E:
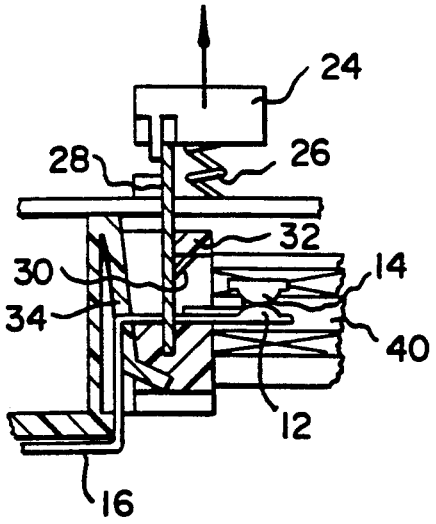

The GFCI receptacle of the present invention includes an improved trip/reset mechanism, generally indicated at 10 in the drawing figures, for resetting a pair of line and neutral movable contacts 12 to closed circuit positions respectively engaging line and neutral fixed contacts 14, as seen in FIG. 1(*e*), and for tripping the movable contacts to open circuit positions in gapped relation with the fixed contacts, as seen in FIG. 1(*b*). The movable contacts are carried at the free ends of resilient conductor straps 16 which are sprung downwardly, such that the movable contacts are normally biased by the straps to their open circuit positions.

Figure 3:
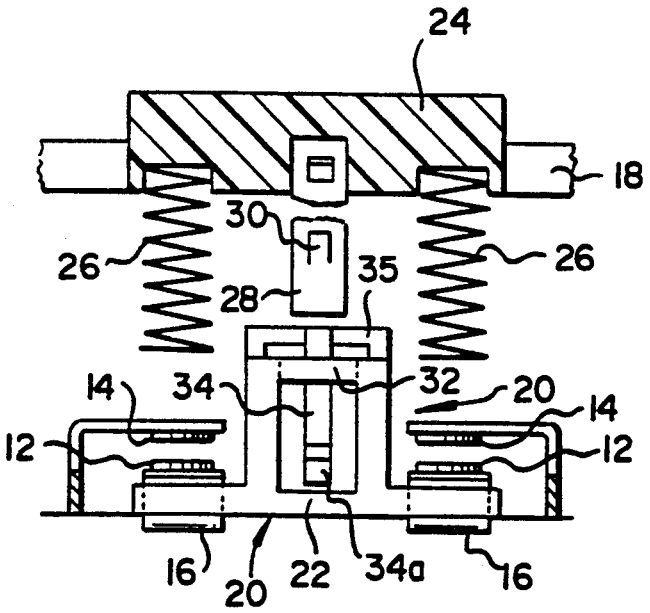
FIG. 3 is a transverse sectional view of the GFCI receptacle of the present invention.

Mounted by the molded plastic case 18 of the receptacle for reciprocating movement between a tripped position seen in 1(*a*) and a reset position seen in FIG. 1(*e*) is a commutator, generally indicated at 20. As best seen in FIG. 3, the commutator includes a cross beam 22 extending transversely under the straps 16 such that when the commutator is elevated to its reset position, the straps are flexed upwardly to draw the movable contacts 12 into their closed circuit positions. Also mounted for reciprocation by case 18 is a manual reset actuator in the form of a pushbutton 24. Reset compression springs 26 bias the pushbutton to an elevated, trip-indicating position seen in FIG. 1(*a*). Manual depression of the pushbutton moves it to a depressed position seen in FIG. 1(*d*). An elongated latch in the form of a metallic strip 28 is pivotally connected at its upper end to the underside of the reset button 24 and depends inwardly of case 18 toward commutator 20. A catch 30 is struck from the latch at a mid-length location such that, upon depression of the reset button to its fully depressed position, latch 28 descends sufficiently to permit the catch to latchingly engage the underside of a transverse latch shoulder 32, an integrally formed feature of the commutator.

As an important feature of the present invention, a separate latch spring 34 is provided to act against the lower end of latch 28 during its descension in response to reset button depression in a manner to control its angular orientation. Specifically, spring 34 asserts a latch setting force on the latch once its catch clears the vertical face of the latch shoulder to ensure that the catch swings into full latching engagement with the underside of the latch shoulder, as depicted in FIG. 1(*e*). When the reset button is then released, reset springs 26 raise the reset button, latch 28, commutator 20 and movable contacts 12 in unison. When the movable contacts engage fixed contacts 14 to assume their closed circuit positions and thus established the commutator and reset button in their respective reset positions. It is thus seen that the reset springs additionally serve to provide the contact closing force and the requisite contact pressure for good circuit continuity. It is also important to note that, while the reset button is in its reset position, latch 28 is displaced from spring 34, as seen in FIG. 1(*e*), and thus exerts no forces on the trip/reset mechanism while the receptacle is in its circuit closure, reset condition.

As an additional feature of the present invention, latch spring 34 is beneficially formed as an integral feature of receptacle case 18. Thus, as seen in the illustrated embodiment of the invention, this spring is in the form of a cantilever mounted leaf spring integrally joined at one end with a vertical wall feature 35 of the receptacle and depending to a crooked free end portion 34*a* fashioned for engagement with the free end of latch 28.

To trip mechanism 10 in response to a detected ground fault, the receptacle is equipped with a solenoid 36 positioned within case 18 and including a coil 38 surrounding a plunger 40 having a large diameter body 40*a* and a reduced diameter, axially extending actuating pin 40*b*. A U-shaped frame 42 maintains the solenoid assembly and includes a close fitting hole 44 in one leg 42*a* through which plunger body 40*a* can protrude when the plunger assumes a quiescent return position and a close fitting hole 46 in its other leg 42*b* through which actuating pin 40*b* extends. When the solenoid coil is energized, the plunger is magnetically propelled leftward to an extended position established by engagement of the plunger body against the inner side of frame leg 42*b*.

In accordance with an important feature of the present invention, it will be noted that the trip solenoid does not include a return spring for normally biasing plunger 40 to the rightward return position. Thus the trip solenoid is not required to generate additional magnetic force to overcome any spring force brasing the plunger and/or latch to reset positions. Thus the trip solenoid can be reduced in size and cost.

In accordance with an additional feature of the present invention, latch spring 34 is advantageously utilized to restore trip solenoid plunger 40 to its return position from its trip-initiating extended position. When reset button 24 is depressed to reset the receptacle, the latch spring eventually pivots latch 28 rightward to set catch 30 in engagement with shoulder, and, in the process, the latch engages the tip of actuating pin 40*b* to drive plunger 40 rightward to its return position. Thus the latch spring serves dual purposes, to wit, as a latch setting spring and as a trip solenoid plunger return spring.

Reviewing the operation of trip/reset mechanism 10, to reset the receptacle from its tripped condition of FIG. 1(*a*), reset button 24 is manually depressed. As latch 28 descends, catch 28 runs against the vertical face of latch shoulder 30 as seen in FIG. 1(*b*). As the reset button achieves its depressed position, the lower, free end of the latch engages and flexes latch spring 34 to a charged condition, as seen in FIG. 1(*c*). Once catch 28 clears the latch shoulder vertical face, the latch spring discharges to set latch 28 with the catch in full latching engagement with the underside of latch shoulder and also to restore solenoid plunger to its return position, all as illustrated in FIG. 1(*d*). Note that the movable contacts 12 still remain in their open circuit positions. When the reset button is released, the now charged reset springs 26 discharge to drive the reset button, latch, and commutator 20 upward to bring movable contacts 12 to their closed circuit positions in engagement with fixed contacts 14, as seen in FIG. 1(*e*). The receptacle is then reset.

Note that digital pressure on the reset button cannot hold the movable contacts in their closed circuit positions in the face of a ground fault. As seen from FIG. 1(*e*), the solenoid remains free to trip mechanism 10 and thus allow the movable contacts to spring to their open circuit positions. If the reset button is held fully depressed, the mechanism parts assume their positions of FIG. 1(*d*), wherein the movable contacts are in their open circuit positions. Again note that latch spring 34 is fully relaxed and no longer engaging latch 28 while the receptacle is reset. Thus, this spring exerts no force on mechanism 10 as it stands ready to respond to a ground fault.

Figure 2:
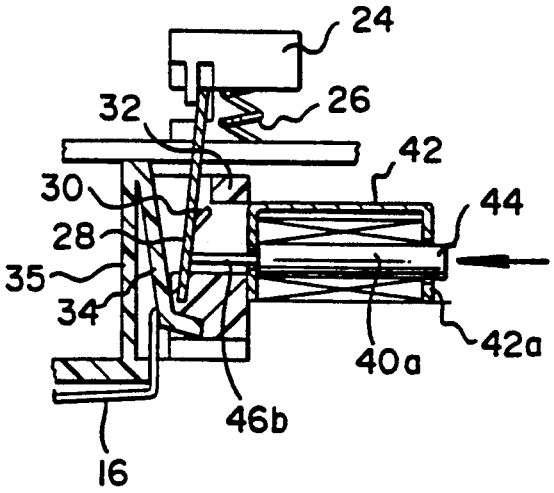
FIG. 2 is a fragmentary view of the GFCI receptacle of FIGS. 1(*a*)–1(*e*) illustrating operation of a trip solenoid to trip the GFCI receptacle from its reset condition of FIG. 1(*e*) to its tripped condition of FIG. 1(*a*)

With the GFCI receptacle residing in its in-service, reset condition of FIG. 1(*e*), to execute a ground fault trip function, solenoid coil 38 is energized to magnetically drive plunger 40 leftward to impact its actuating pin 40*b* against latch 28 at location below catch 30. In response, the latch is swung leftward to disengage catch 30 from latch shoulder 32, as illustrated in FIG. 2(*a*). Note that the crooked free end portion of latch spring 34 is displaced below the lower end of latch and thus is clear of this leftward, unlatching motion. With unlatched commutator 20 disconnected from reset springs 26, the movable contacts are no longer held in their closed circuit positions, and thus resilient straps 16 can discharge to spring the movable contacts to their open circuit positions. The GFCI receptacle thus assumes the tripped condition of FIG. 1(*a*).

It is seen that the objectives set forth above, including those made apparent from the foregoing Detailed Description, are efficiently attained, and, since certain changes may be made in the construct set forth without departing from the present invention, it is intended that matters of detail be taken as illustrative and not in a limiting sense.

Having described the invention, what is claimed as new and desired to secure by Letters Patent is:

1. A circuit interrupter comprising, in combination:

A. a molded plastic case;

B. a fixed contact disposed within said case;

C. a movable contact disposed within said case;

D. means biasing said movable contact to an open circuit position relative to said fixed contact;

E. a commutator mounted by said case for reciprocating movement between a tripped position and a reset position holding said movable contact in a closed circuit position engaging said fixed contact against the opening force of said biasing means;

F. a manual reset actuator mounted by said case for reciprocating movement between a released position and a depressed position;

G. a reset spring biasing said reset actuator to said release position;

H. a latch connected to said reset actuator for movement between an unlatched position and a latched position latching said commutator in said reset position;

I. a trip solenoid including a coil and a plunger freely movable between an extended position and a return position, energization of said coil magnetically driving said plunger from said return position to said extended position, thereby deflecting said latch from said latched position to said unlatched position and allowing said movable contact to assume said open circuit position; and J. a latch spring positioned in said case to be charged by engagement with said latch as said reset actuator is depressed from said release position to said depressed position, whereby to provide a spring force for shifting said latch from said unlatched position to said latched position and shifting said plunger from said extended position to said return position, said latch spring being disengaged from said latch while said commutator is in said reset position.

2. The circuit interrupter defined in claim 1, wherein said reset spring is empowered to force said commutator from said tripped position to said reset position and said movable contact from said closed circuit position to said closed circuit position when said commutator is latchingly engaged by said latch.

3. The circuit interrupter defined in claim 2, wherein said latch spring is in the form of a cantilever mounted leaf spring.

4. The circuit interrupter defined in claim 3, wherein said latch spring is an integrally formed feature of said molded plastic case.

5. The circuit interrupter defined in claim 2, wherein said biasing means is a resilient conductor strap having a free end mounting said movable contact.

6. The circuit interrupter defined in claim 5, wherein said latch is in the form of an elongated strip having a first end portion pivotally connected to said reset actuator and a second end portion engageable by said latch spring and said plunger, said latch further including a catch positioned intermediate said first and second end portions for latchingly engaging said commutator.

7. The circuit interrupter defined in claim 6, wherein said latch spring is in the form of a cantilever mounted leaf spring.

8. The circuit interrupter defined in claim 7, wherein said latch spring is an integrally formed feature of said molded plastic case.

9. The combination defined in claim 8, wherein said circuit interrupter is a GFCI receptacle having two pairs of said fixed and movable contacts and a pair of said resilient conductive straps having free ends respectively mounting said pair of movable contacts.

10. The GFCI receptacle defined in claim 9, wherein said commutator includes a cross beam disposed in underlying, engaging relation with said pair of conductive straps to draw said pair of movable contacts into said closed circuit positions as said commutator is shifted from said tripped position to said reset position by said reset spring.

* * * * *